US008349094B2

(12) United States Patent
Boerner et al.

(10) Patent No.: US 8,349,094 B2
(45) Date of Patent: Jan. 8, 2013

(54) DINING AND/OR SERVING CUTLERY MADE OF FERRITIC STAINLESS STEEL WITH A MARTENSITIC BOUNDARY LAYER

(75) Inventors: Cornelius Boerner, Kuchen (DE); Guenter Buehlmaier, Geislingen (DE); Wolfgang Friz, Goeppingen (DE); Alexander Kiefer, Kuchen (DE); Martin Neumayer, Gerstetten-Dettingen (DE); Theda Staudinger, Geislingen (DE)

(73) Assignee: WMF Aktiengesellschaft, Geislingen/Steige (DE)

( * ) Notice: Subject to any disclaimer, the term of this patent is extended or adjusted under 35 U.S.C. 154(b) by 463 days.

(21) Appl. No.: 12/449,233

(22) PCT Filed: Jan. 29, 2008

(86) PCT No.: PCT/EP2008/000680

§ 371 (c)(1), (2), (4) Date: Feb. 23, 2010

(87) PCT Pub. No.: WO2008/092640

PCT Pub. Date: Aug. 7, 2008

(65) Prior Publication Data

US 2010/0175269 A1 Jul. 15, 2010

(30) Foreign Application Priority Data

Feb. 2, 2007 (EP) ..... 07002295

(51) Int. Cl.
*C22C 38/18* (2006.01)

(52) U.S. Cl. ..... 148/318; 148/230

(58) Field of Classification Search ..... 148/318, 148/206–238
See application file for complete search history.

(56) References Cited

U.S. PATENT DOCUMENTS 2,452,915 A * 11/1948 Feild ..... 148/230
4,366,008 A * 12/1982 Takeuchi et al. ..... 148/219

FOREIGN PATENT DOCUMENTS

| | | | |
|---|---|---|---|
| DE | 40 33 706 | A1 | 2/1991 |
| DE | 196 26 833 | A1 | 1/1998 |
| DE | 10 2004 039926 | A1 | 2/2006 |
| EP | 0 652 300 | A1 | 5/1995 |
| EP | 0 936 280 | A1 | 8/1999 |
| GB | 2 160 227 | A | 12/1985 |
| JP | 57-098674 | A | 6/1982 |

(Continued)

OTHER PUBLICATIONS

Li, C.X. et al; Corrosion properties of plasma nitrided AISI 410 martensitic stainless steel in 3.5% NaC1 and 1% HCl aqueous solutions; Corrosion Science, 2006; 2037-2049; vol. 48; Department of Mettallury and Material, The University of Birmingham, Birmingham UK.

(Continued)

*Primary Examiner* — Deborah Yee
(74) *Attorney, Agent, or Firm* — Marshall & Melhorn, LLC

(57) ABSTRACT

The invention relates to dining and/or serving cutlery made of a steel material which is formed from a ferritic core with an essentially martensitic boundary layer. In the dining and/or serving cutlery of the invention, the surface hardness of the boundary layer, determined according to the hardness test according to Vickers HV 3, is thereby greater by 30 to 300% than the lowest hardness of the core, likewise measured according to Vickers HV 3.

16 Claims, 1 Drawing Sheet

FOREIGN PATENT DOCUMENTS

| | | | |
|---|---|---|---|
| JP | 57-149127 | A | 9/1982 |
| JP | 06-306574 | A | 11/1994 |
| JP | 11-199923 | A | 7/1999 |
| JP | 2005-336567 | A | 12/2005 |
| WO | WO 2006/018348 | A1 | 2/2006 |

OTHER PUBLICATIONS

Lampman et al: "Heat Treating", ASM Handbook, vol. 4, (1991); XP-002481274, Gas Nitriding; pp. 401-402.

* cited by examiner a)
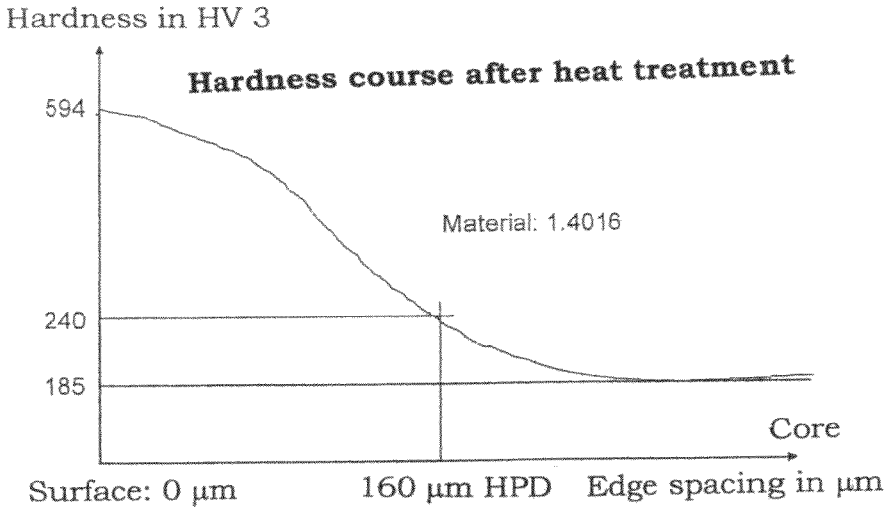
b)
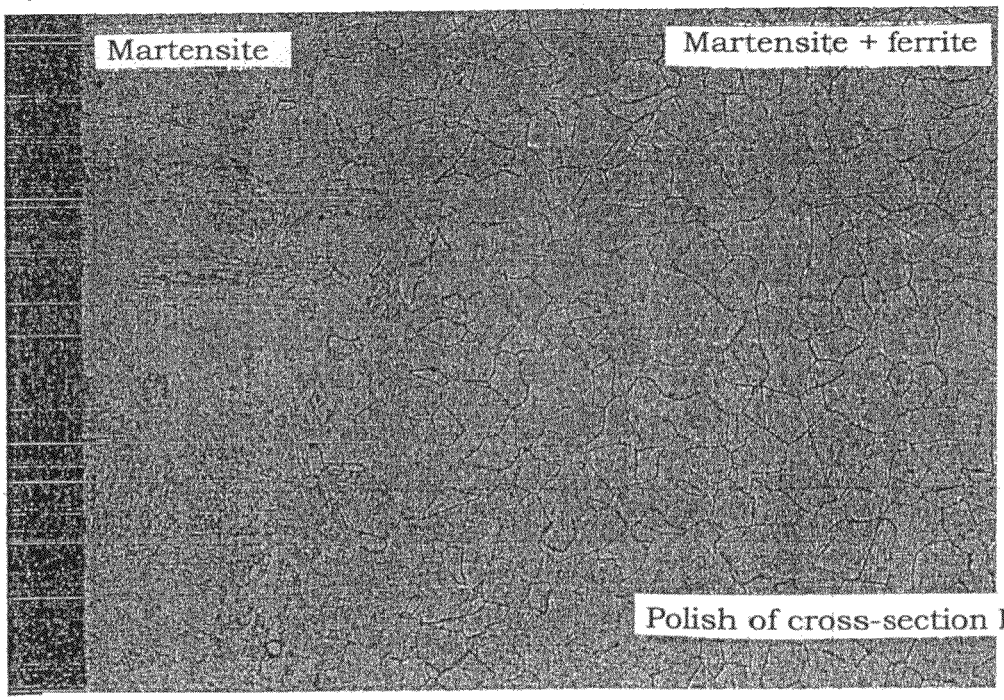

DINING AND/OR SERVING CUTLERY MADE OF FERRITIC STAINLESS STEEL WITH A MARTENSITIC BOUNDARY LAYER

BACKGROUND OF THE INVENTION

The invention relates to dining and/or serving cutlery made of a steel material which is formed from a ferritic core with an essentially martensitic boundary layer. In the case of the dining and/or serving cutlery of the invention, the surface hardness of the boundary layer, determined according to the hardness test according to Vickers HV 3, is thereby greater by 30 to 300% than the lowest hardness of the core, likewise measured according to Vickers HV 3.

In the case of dining and/or serving cutlery, in particular in the case of knives, the basic material of the blade which usually comprises steel normally is hardened by a heat treatment in order to improve the cutting ability and the edge-holding property. The type of heat treatment thereby depends also upon the steel which is used, i.e. whether a low-alloy steel or a high-alloy steel is used.

There are thereby possible basically as heat treatment methods standard methods, such as e.g. a temperature treatment in a furnace. The hardening temperature which must be used for such processes, thereby depends upon the type of steel and can be above 1000° C.

Furthermore, hardening methods have also become known already in the state of the art, in which hardening is implemented by means of a laser beam and/or electron beam.

However it has now been shown in practice that these heat treatment methods and/or the other hardening methods mentioned above with respect to dining and/or serving cutlery do not always lead to satisfactory results. The main reason resides in the fact that, as a result of the above-mentioned hardening methods, generally complete hardening throughout of the steel material is achieved, however the usability required in total for dining and/or for serving cutlery then suffering in such a manner that the individual parts, e.g. a knife or a fork, are impaired in particular in their elastic properties. It has been shown furthermore that, in many cases, the surface hardness which can be achieved consequently is also not sufficient to prevent scratching of the dining and/or serving cutlery in constant use. In some cases, rusting of the surface was also detected.

A hardening method of a martensitic steel (ASI 410) is known from Corrosions Science 48 (2006) 2036-2049 by C. X. Li.

Therefore there is still a great requirement to improve dining and/or serving cutlery such that a high elasticity is present also for long term use, with simultaneously excellent surface properties with respect to scratch resistance and corrosion resistance.

BRIEF SUMMARY OF THE INVENTION

Starting herefrom, it is the object of the present invention to indicate dining and/or serving cutlery which is superior to the state of the art in its elasticity and which has at the same time such high surface hardness and a surface property that scratching is extensively avoided and corrosion resistance is achieved even in long term use.

This object is achieved by the characterising features of patent claim 1. The sub-claims reveal advantageous developments.

BRIEF DESCRIPTION OF THE DRAWINGS

In The Accompanying Drawings:

FIG. 1*a* is a graphic representation of the hardness course after heat treatment.

FIG. 1*b* is a polish of cross section with a 50:1 enlargement.

DETAILED DESCRIPTION OF THE INVENTION

According to the invention, it is hence proposed that a ferritic steel material is used for the dining and/or serving cutlery of the invention which has an essentially martensitic boundary layer. The boundary layer can thereby be configured on one side or several sides or surrounding the core. The invention thereby also jointly includes embodiments in which the boundary layer has in addition a small proportion of residual austenite as a function of the C- and N-content of the steel material included therein. It is essential for the invention that, between the surface hardness of the boundary layer and the lowest hardness of the core, there is a hardness difference, measured according to Vickers HV 3, of at least 30 to 300%. The dining and/or serving cutlery according to the invention is distinguished in addition in that it has, irrespective of the above-mentioned hardness difference, also a difference with respect to the modulus of elasticity between the martensitic boundary layer and the core of the material. According to the invention, the martensitic boundary layer has a modulus of elasticity measured, in $kN/mm^2$, which is greater by 1 to 100% than the modulus of elasticity of the core material.

It has now been shown that dining and/or serving cutlery which fulfils the above-mentioned conditions achieves the object set according to the present invention. This can obviously be attributed to the fact that, according to the invention, the core is allowed to be relatively elastic, i.e. is formed from a ferritic material which retains the inherent properties per se of the untreated steel material and that then merely the boundary layer is configured such that a hardness difference or a difference in the modulus of elasticity, as described above, is set here. In tests, the applicant was thereby able to show that not only very high elasticity of the dining and/or serving cutlery according to the invention is present but that also scratching of the surface can be extensively avoided.

In the case of the dining and/or serving cutlery according to the invention, it is thereby preferred if the hardness difference between the surface hardness of the boundary layer relative to the lowest hardness of the core is 80 to 250%, preferably 100 to 250%. Preferably, the surface hardness of the martensitic boundary layer can thereby be in the range of 320 to 650 HV 3 and the lowest hardness of the core in the range of 160 to 260 HV 3. With respect to the hardness test according to Vickers, reference is made to the known standards according to DIN EN ISO 6507.

It is particular favourable for the modulus of elasticity if a modulus of elasticity is present here between the martensitic boundary layer and the material core, having the proviso that the modulus of elasticity in the boundary layer is greater by 1 to 50% than that of the core. The determination of the modulus of elasticity in $kN/mm^2$ was thereby effected at 20° C.

According to the invention, the boundary layer of the dining and serving cutlery of the invention is defined by a hardness penetration depth (HPD) which progresses from the lowest hardness of the core, measured according to HV 3, +30% up to the surface of the boundary layer. In the present invention, the hardness penetration depth (HPD) can thereby be in the range of 0.005 mm to 1.0 mm, preferably 0.01 mm to 0.4 mm and particularly preferred in the range of 0.01 to 0.3 mm.

A further characteristic of the boundary layer according to the invention is that, within the martensitic boundary layer, the hardness and also the modulus of elasticity reduces starting from the surface in the direction of the core, as defined above. The reduction in hardness or in the modulus of elasticity can thereby be effected continuously and/or also in a gradient. The greatest quantity for reduction in hardness or in the modulus of elasticity is thereby in the region of the boundary layer itself close to the surface.

In the dining and serving cutlery according to the invention, it is preferred in addition if the surface of the martensitic boundary layer is roughened and/or made matte. The surface roughness can thereby be in the range of 1.5 μm to 4.0 μm. Roughnesses of 1.9 μm to 2.8 μm (Scotch tape) or 1.7 μm to 2.1 μm (brushed) are preferred. In contrast, polished surfaces have a roughness of 0.8 μm to 1.3 μm.

It has hereby been shown that, even dining and/or serving cutlery present with a matte-finish due to continual use also for example in dishwashers, damage to the surface by scratches is reduced. This is attributed to the configuration of the martensitic boundary layer, as already described above, in combination with the flexible or elastic core.

From a material point of view, in principle all ferritic steels can be used in the dining and serving cutlery according to the invention.

Examples of ferritic steels are: 1.4000 and 1.4024. The steels 1.4021 and also 1.4016 are thereby preferred. An essential advantage of the dining and serving cutlery according to the invention now resides in the fact that a steel which has relatively low hardness and hence high elasticity can be selected and that the martensitic boundary layer is then subsequently configured by the treatment method described below. Due to the martensitic boundary layer, a significant increase in hardness then results, whilst maintaining the elastic core, with which then superior properties with respect to scratch and corrosion resistance are achieved.

In addition, it has been shown that the surface of the boundary layer has a textured configuration which is distinguished by a higher particle size in comparison with untreated steels, and also in that no chromium carbide precipitations take place at the particle boundaries.

With respect to the dining and serving cutlery, the invention fundamentally includes all corresponding objects which are known to the person skilled in the art. Examples thereby are knives, spoons, forks, biscuit and cake slices, ladles, tongs and servers.

In the dining and serving cutlery according to the invention, the configuration of the martensitic boundary layer is achieved by a heat treatment and a so-called "nitriding". The nitriding of steel materials is known per se in the state of the art and is described for example in EP 0 652 300 A1 or also in DE 40 33 706.

In edge nitriding, the process thereby takes place such that the steel material is treated at a temperature between 1000° C. and 1200° C. in a nitrogen-containing gas atmosphere and subsequent cooling.

It has now been shown surprisingly that such a method (which is known e.g. in the state of the art also under the term "SolNit process") leads to superior properties with respect to dining and serving cutlery. It is thereby essential, as described already above, that the above-mentioned conditions are maintained in the dining and serving cutlery of the invention.

The invention is described subsequently in more detail with reference to FIGS. 1*a* and 1*b* without restricting the subject of the invention to this.

FIG. 1 shows both the hardness course after a heat treatment in the example of the type of steel 1.4016 in the form of a graphic representation and also in FIG. 1*b* a polish of cross-section with a 50:1 enlargement.

In this example case according to FIG. 1, a tablespoon by the company WMF made of the type of steel 1.4016 was nitrided at temperatures of above 1050° C. with nitrogen and quenched or deep-cooled and annealed. The material 1.4016, X7 chromium 17 is a ferritic steel with 0.06 to 0.1% carbon. By including nitrogen, the result is stresses in the lattice, martensite is produced during the annealing, which reduces towards the core corresponding to the inclusions, as can be seen in FIG. 1*b*.

As emerges from FIG. 1*a*, the tablespoon has a surface hardness of 594 HV 3. The hardness penetration depth in the case of the example was 106 μm. Calculation of the hardness penetration depth is implemented according to the invention such that it starts from the lowest hardness of the core, likewise measured in HV 3, +30%. In the case of the example, the starting value is hence 240 HV 3.

FIG. 1*b* shows very clearly the texture configuration from which the martensitic boundary layer can be detected and the essentially ferritic core. The treated surface thereby has an average particle diameter of 28 to 40 μm, measured according to the average measurement method. The particle diameter of the treated part in the core is 15 to 20 μm and that of the untreated starting material 10 to 14 μm linearly.

Astonishingly it was now established that dining and/or serving cutlery with the above-described surface configuration has superior corrosion and scratch resistance.

The invention claimed is:

1. A dining and/or serving cutlery made of a ferritic steel material with a boundary layer which is formed by a heat treatment with nitriding and subsequent cooling and is essentially martensitic, having the proviso that the surface hardness of the boundary layer, determined according to the hardness test according to Vickers HV 3 (DIN ISO EN 6507), is greater by 30 to 300% than the lowest hardness of the core measured according to HV 3, wherein the steel material is selected from 1.4016 (AISI 430), 1.4000 (AISI 410) and 1.4024 (AISI 403).

2. The dining and/or serving cutlery according to claim 1, wherein the hardness difference between the surface hardness of the boundary layer relative to the lowest hardness of the core is 80 to 250%.

3. The dining and/or serving cutlery according to claim 2, wherein the surface hardness of the boundary layer is in the range of 320 to 650HV 3 and the lowest hardness of the core is in the range of 160 to 260 HV 3.

4. The dining and/or serving cutlery according to claim 1, wherein the boundary layer is defined by a hardness penetration depth (HPD) which progresses from the lowest hardness of the core, measured according to HV 3, +30% up to the surface of the boundary layer.

5. The dining and/or serving cutlery according to claim 4, wherein the HPD is in the range of 0.005 mm to 1.00 mm.

6. The dining and/or serving cutlery according to claim 1, wherein the martensitic boundary layer has a modulus of elasticity in $kN/mm^2$ which is greater by 1 to 100% than the modulus of elasticity in $kN/mm^2$ of the material core.

7. The dining and/or serving cutlery according to claim 4, wherein the modulus of elasticity of the martensitic boundary layer is greater by 1 to 50% than the modulus of elasticity of the core.

8. The dining and/or serving cutlery according to claim 1, wherein within the martensitic boundary layer, the hardness and/or the modulus of elasticity reduces starting from the surface towards the core.

9. The dining and/or serving cutlery according to claim 1, wherein the surface of the martensitic boundary layer is roughened and/or made matte.

10. The dining and/or serving cutlery according to claim 9, wherein the surface roughness is in the range of 1.5 μm to 4.0 μm, measured according to DIN ISO EN 4287.

11. The dining and/or serving cutlery according to claim 1, wherein particles at the surface of the martensitic boundary layer have no chromium carbide precipitations at the their boundaries.

12. The dining and/or serving cutlery according to claim 1, wherein particles at the surface of the martensitic boundary layer have a higher particle size in comparison with those in an unhardened surface.

13. The dining and/or serving cutlery according to 1, wherein it is a knife, a fork or a spoon.

14. The dining and/or serving cutlery according to claim 1, wherein the hardness difference between the surface hardness of the boundary layer relative to the lowest hardness of the core is 100 to 250%.

15. The dining and/or serving cutlery according to claim 4, wherein the HPD is in the range of 0.01 mm to 0.4 mm.

16. The dining and/or serving cutlery according to claim 4, wherein the HPD is in the range of 0.01 to 0.3 mm.

* * * * *